US006746599B2

(12) United States Patent
Cymerman et al.

(10) Patent No.: US 6,746,599 B2
(45) Date of Patent: Jun. 8, 2004

(54) STAGED SETTLING PROCESS FOR REMOVING WATER AND SOLIDS FROM OILS AND EXTRACTION FROTH

(75) Inventors: George Cymerman, Edmonton (CA); Pat Dougan, Edmonton (CA); Tom Tran, Edmonton (CA); Jim Lorenz, Edmonton (CA); Corey Mayr, Fort McMurray (CA)

(73) Assignees: AEC Oil Sands Limited Partnership, Calgary (CA); Athabasca Oil Sands Investments Inc., Calgary (CA); Nexen Inc., Calgary (CA); Canadian Oil Sands Investments Inc., Calgary (CA); Gulf Canada Resources Limited, Calgary (CA); Imperial Oil Resources, Calgary (CA); Mocal Energy Limited, Tokyo (JP); Murphy Oil Company Ltd., Calgary (CA); Petro-Canada, Calgary (CA)

( * ) Notice: Subject to any disclaimer, the term of this patent is extended or adjusted under 35 U.S.C. 154(b) by 0 days.

(21) Appl. No.: 09/877,260

(22) Filed: Jun. 11, 2001

(65) Prior Publication Data

US 2003/0029775 A1 Feb. 13, 2003

(51) Int. Cl.[7] ..... C10G 1/04
(52) U.S. Cl. ..... 208/390; 208/187; 208/391
(58) Field of Search ..... 208/390, 187, 208/391

(56) References Cited

U.S. PATENT DOCUMENTS 5,290,433 A * 3/1994 Chan et al. ..... 208/391
6,214,213 B1 * 4/2001 Tipman et al. ..... 210/106
6,358,404 B1 * 3/2002 Brown et al. ..... 208/390

* cited by examiner

*Primary Examiner*—Walter D. Griffin
*Assistant Examiner*—James Arnold, Jr.
(74) *Attorney, Agent, or Firm*—Millen, White, Zelano & Branigan, P.C.

(57) ABSTRACT

Diluent-diluted bitumen froth containing bitumen and naphtha diluent, hydrocarbons, water, sand and fines (collectively "dilfroth") is fed into a vapor-tight gravity settler ('splitter') and temporarily retained to produce a bottom layer of tails comprising sand and middlings, a rag layer of discrete three-dimensional structures, each comprising hydrocarbons contained in a skin of fines, and a top layer of hydrocarbons containing small droplets of water and fines ('raw dilbit'). The flux in the splitter is less than 6 $m^3/h$ of dilfroth fed per $m^2$ of horizontal cross-sectional rag area. The in-coming dilfroth is fed directly into the splitter middlings. Demulsifier is added to the overflow stream of raw dilbit and the mixture is subjected to prolonged settling in a vapor-tight polisher tank, to produce polished dilbit containing less than 1.0 wt. % water and 0.3 wt. % solids. The splitter underflow tails, containing less than 15 wt. % bitumen, is mixed with additional diluent to raise the diluent/bitumen ratio to 4:1 to 10:1 and is gravity settled in a vapor-tight scrubber. Scrubber overflow, mostly diluent containing residual bitumen stripped from the tails, is recycled to the splitter. In concept, the sand is first separated from the bitumen in the stripper. The substantially sand-free bitumen can then feasibly be treated with chemical demulsifier and subjected to prolonged settling in the polisher to reduce water and fines contents to low levels. Bitumen lost with the splitter tails is recovered in the scrubber using a high concentration of diluent. The scrubber overflow of bitumen and diluent is recycled to the stripper to conserve diluent.

15 Claims, 4 Drawing Sheets

FIG. 3 DILUTE BITUMEN DEHYDRATION BY SETTLING
80°C, N/B - 0.65, NO DEMULSIFIER
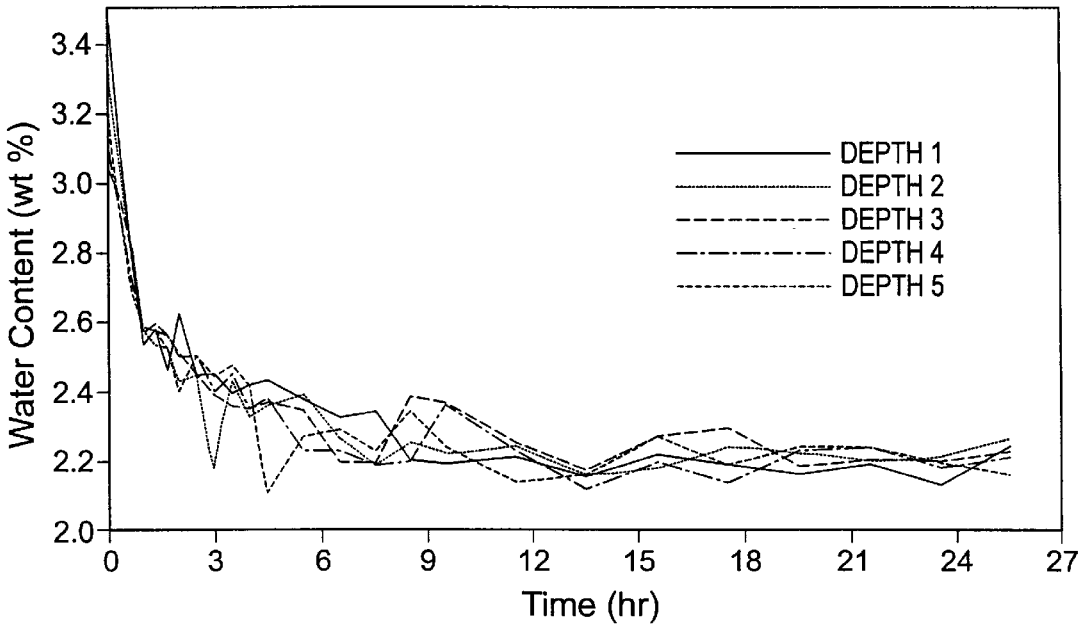
FIG. 4 DILUTE BITUMEN DEHYDRATION BY SETTLING
80°C, N/B - 0.65, 40 PPM CHAMPION MR 121-6
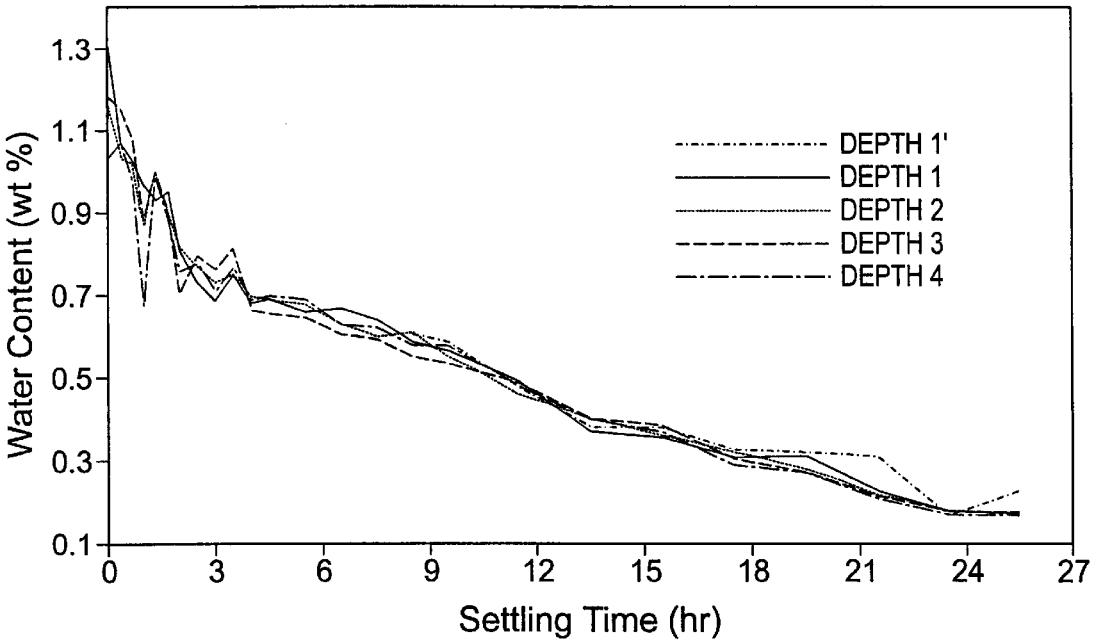

STAGED SETTLING PROCESS FOR REMOVING WATER AND SOLIDS FROM OILS AND EXTRACTION FROTH

FIELD OF THE INVENTION

The present invention relates to a staged gravity settling process for removing contaminants, namely water and particulate solids, from light hydrocarbon diluent-diluted bitumen froth derived from water-based extraction of bitumen from oil sand.

BACKGROUND OF THE INVENTION

Oil sand, as known in the Fort McMurray region of Alberta, Canada, comprises water-wet, coarse sand grains having flecks of a viscous hydrocarbon, known as bitumen, trapped between the sand grains. The water sheaths surrounding the sand grains contain very fine clay particles. In summary then, oil sand comprises: bitumen; particulate solids (coarse sand and clay "fines"); and water. A sample of oil sand, for example, might comprise 70% by weight sand, 14% fines, 5% water and 11% bitumen. (All % values stated in this specification are to be understood to be % by weight.)

When mixed with hot water, the bitumen will separate from the sand grains and be dispersed into the water phase.

For the past 25 years, the bitumen in McMurray oil sand has been commercially recovered using a water-based process. In the first step of this process, the oil sand is slurried with hot water, steam, usually some caustic and naturally entrained air. The slurry is mixed, for example in a tumbler or pipeline, for a prescribed retention time, to initiate a preliminary separation or dispersal of the bitumen and solids and to induce air bubbles to contact and aerate the bitumen. This step is referred to as "conditioning". The conditioned slurry is then further diluted with hot water and introduced into a large, open-topped, conical-bottomed, cylindrical vessel (termed a primary separation vessel or "PSV"). The diluted slurry is retained in the PSV under quiescent conditions for a prescribed retention period. During this period, aerated bitumen rises and forms a froth layer, which overflows the top lip of the vessel and is conveyed away in a launder. Sand grains sink and are concentrated in the conical bottom. They leave the bottom of the vessel as a wet tailings stream containing a small amount of bitumen. Middlings, a watery mixture containing solids and bitumen, extend between the froth and sand layers.

The wet tailings and middlings are separately withdrawn, combined and sent to a secondary flotation process. This secondary flotation process is commonly carried out in a deep cone vessel wherein air is sparged into the vessel to assist with flotation. This vessel is referred to as the TOR vessel. The bitumen recovered by flotation in the TOR vessel is recycled to the PSV. The middlings from the deep cone vessel are further processed in induced air flotation cells to recover contained bitumen.

The hot froths (80–85° C.) produced by the PSV and flotation cells are combined and subjected to cleaning, to reduce water and solids contents.

More particularly, it has been conventional to dilute this bitumen froth with a light hydrocarbon diluent, specifically naphtha, to increase the difference in specific gravity between the bitumen and water and to reduce the bitumen viscosity, to thereby aid in the separation of the water and solids from the bitumen. By way of example, the composition of naphtha-diluted bitumen froth typically might have a naphtha/bitumen ratio of 0.65 and contain 20% water and 7% solids.

This diluent-diluted bitumen froth, derived from water-based extraction of bitumen from oil sand, is commonly referred to as "dilfroth".

Separation of the bitumen from water and solids is then carried out. This may be done by treating the dilfroth in a sequence of scroll and disc centrifuges. Alternatively, the dilfroth may be subjected to gravity separation in a series of inclined plate separators ("IPS") in conjunction with countercurrent solvent extraction using added light hydrocarbon diluent.

These prior art centrifuge and IPS techniques for removing water and particulate solids from dilfroth have not been entirely satisfactory. Typically the "cleaned" froth, (commonly referred to as "dilbit"), may still contain at least 1.5% water and 0.5% solids. These contaminants cause problems in the downstream refinery-type processes used to upgrade the dilbit to produce useful end products. More particularly, the water contains chlorides, which cause corrosion in heat exchangers. The solids plug catalysts. For these reasons, the upgrading sector of these plants have specified that the dilbit should contain <1.0% water and <0.3% solids.

Researchers have long sought to develop a practical and viable alternative process which would reliably produce dilbit having the specified smaller concentrations of water and solids. It would be even more desirable to reduce the contamination to levels in the order of <0.5% water and <0.2% solids. In addition, it would be desirable to achieve this using a system which eliminates the centrifuges, as these are expensive to operate and cause emulsification. However, solutions have been constrained by the following realities:

- the clays and asphaltenes in the bitumen have an affinity for each other. They tend to concentrate at water/hydrocarbon interfaces and act to limit coalescence of water droplets into larger globules that would settle rapidly to enable further reduction of water content in the dilbit product;
- the loss of bitumen with tails must be minimal, as this is environmentally undesirable and of course reduces oil recovery;
- NIB ratio in dilbit should not exceed 0.8; and
- given the huge volumes processed in these operations, the equipment used should be simple and reasonably inexpensive to operate and additives, such as demulsifiers, should be used only sparingly.

SUMMARY OF THE INVENTION

In accordance with one embodiment of the invention, the following steps are practised in combination:

Dilfroth, preferably having a naphtha/bitumen ratio of 0.5:1 to 0.8:1, is fed into a gravity settler vessel, referred to as the "splitter". The splitter has outlet means for withdrawal of solids and aqueous phase from the bottom and outlet means for overflow of the hydrocarbon phase at the top. The vessel should be enclosed at the top and vapor-tight to prevent escape of diluent. The splitter has a feed inlet, preferably intermediate its ends. The vessel may have a sand rake for moving sand to the central bottom outlet. The dilfroth is temporarily retained (for example 15 to 30 minutes) in the splitter chamber so that the froth settles to form a bottom layer of sand and aqueous middlings, a rag layer and a top layer of hydrocarbons (referred to as "dilbit"). Middlings is a mixture comprising mainly water containing some fines and bitumen. An underflow stream of middlings and settled sand, containing some hydrocarbon, (collectively referred to as "splitter tails"), is removed through the bottom outlet. An overflow stream of splitter dilbit is removed through the top outlet. The splitter dilbit comprises hydrocarbons contaminated with, typically 3–5% water and 0.5–2.5% solids. The solids are almost entirely fines. The splitter tails comprise mostly water, typically containing 10–25% solids and 8–20% hydrocarbons;

In an optional or preferred feature, the dilfroth is directly introduced into the splitter middlings layer, beneath the rag layer and above the settled sand. The reason for this is explained below;

In another preferred feature, the feed rate of dilfroth to the splitter, per square meter of horizontal cross-sectional rag or vessel chamber area, is maintained below 6 $m^3$/h of dilfroth for each m2 of rag area. More preferably, the feed rate is maintained at about 4 $m^3$/h or less. Otherwise stated, the hydrocarbons/water interface area loading rate or flux is maintained below 6 m/h, preferably below 4 in/h. It is found that the thickness of the rag layer begins to increase if the flux is high, for example at 8 in/h. As a result, oil loss with the tails increases and/or contamination of the dilbit also increases. The reason for this is explained below;

In another preferred feature, the elevation of the hydrocarbon/middlings interface in the splitter chamber is monitored, for example with a capacitance probe. The rate of introduction of dilfroth and rate of tails removal are controlled in response to the elevation of the interface, so as to maintain separation of the interface from the bottom outlet by keeping the interface at a generally constant elevation. This is controlled so as to preferably maintain the hydrocarbon content in the tails at less than 20%, more preferably less than 15%;

In another preferred feature, the splitter raw dilbit is introduced into a large vapor-tight tank (referred to as the "polisher") and temporarily retained therein for a prolonged period (relative to the retention time in the splitter). For example, the retention time in the polisher might be in the range of 5 to 24 hours.

In another preferred feature, demulsifier is added to the splitter raw dilbit treated in the polisher. As a result of prolonged settling and the use of demulsifier, water droplets coalesce and settle in the polisher chamber, together with fine solids, to produce a polished dilbit overhead product which may contain less than 1.0% water and 0.3% solids, more preferably <0.5% water and <0.2% solids, and a polisher sludge underflow comprising water and fine solids;

In another preferred feature, the splitter tails are mixed with additional naphtha (diluent) and settled in a vapor-tight vessel referred to as the "scrubber". The scrubber is similar in structure to the splitter. The scrubber naphtha/bitumen ratio is quite high, preferably in the range 4:1 to 10:1. At this high naphtha/bitumen ratio, the naphtha strips residual bitumen from the splitter tails, so that there is produced a scrubber overhead stream which is rich in naphtha and contains most of the residual bitumen. This stream is preferably recycled to the splitter feed to help provide the preferred splitter naphtha/bitumen ratio of 0.5:1 to 0.8:1. The scrubber also produces a scrubber tails underflow which is mainly sand, fines and water, typically containing less than 3% bitumen.

With respect to the foregoing, the following will be noted:

That most of the sand and water originally in the dilfroth are separated in the splitter and report to the splitter underflow, leaving a splitter dilbit product containing fine water droplets which are difficult to coalesce and separate by settling—however the volume of the splitter dilbit is now considerably reduced relative to the volume of the dilfroth feed. More importantly, virtually all coarse, fast settling solids have been removed from the raw dilbit;

That in the splitter hydrocarbon losses with the tails are found to be <15 wt. %, typically about 4–10 wt. %, of the hydrocarbons originally in the dilfroth feed—in contrast, in the IPS system, between 35–50 wt. % of the original hydrocarbons go into the tails;

That in the polishing step, it is now viable to add demulsifier to the splitter dilbit (reduced in volume and free of sand) and to use prolonged retention time to coalesce and settle out the residual water and fine solids, thereby producing a polished dilbit product that meets the desired specification of less than 1.0% water and 0.3% solids. Because the solids entering the polisher are primarily fine clays, a flat-bottom, large diameter enclosed tank can be used to provide the prolonged settling (for example in the order of 5 to 24 hours) needed to separate the water and fines; and That in the scrubbing step, a high naphtha/bitumen ratio is used to scrub out residual bitumen in the splitter tails to keep bitumen losses to a very low level. The added naphtha is recycled concurrently to use it efficiently and to help provide the desired naphtha/bitumen ratio in the splitter.

The invention arose from a research program in which the settling behaviour of dilfroth was studied using a glass-walled test circuit. Dilfroth was fed into a glass column splitter through a glass inlet pipe connected with the splitter between its top and bottom ends. The incoming stream of dilute froth was not homogeneous. It comprised easily discernible globes of hydrocarbon, pockets of muddy middlings and grains of coarse sand. As the dilfroth stream entered the vessel chamber, a separation process occurred due to gravity settling. As a result, a lower aqueous phase of middlings and an upper hydrocarbons phase were established. The incoming dilfroth was fed directly into the middlings phase. This middlings phase mainly comprised a suspension of clays in water. The initial separation was rapid (a few seconds). The following actions were observed:

the sand grains (60–150 $\mu$m) settled quickly through the middlings to the base of the vessel chamber. The sand and some middlings were continually withdrawn and pumped to a scrubber, as further described below;

pockets of incoming middlings, containing only traces of hydrocarbon, joined the aqueous phase and became part of it; and the incoming hydrocarbons, present in the form of discrete three dimensional structures, which we referred to as "leaky sacks", floated up through the aqueous phase and collected in a rag layer of other oil sacks at the horizontal interface between the middlings and the layer of hydrocarbons which accumulated above.

The leaky sacks were filled with hydrocarbons and had outer skins formed of sub-micron clay particles. The composite density of the sacks was lower than that of the aqueous middlings (density 1.05–1.1 kg/l) because they would float in the middlings—but the density of the sacks was greater than that of the hydrocarbon phase above the interface, because they would not float in that phase (density 0.76–0.8 kg/l). Hence the composite density of the hydrocarbon laden sacks was apparently between 0.8 and 1.05 kg/l The density of the clay alone was 2.65 kg/l.

The sacks formed the intermediate rag layer, approximately 100 to 200 mm thick at the interface, between the aqueous and hydrocarbon phases. The sacks in the rag layer did not coalesce into larger ones, although some of them did cluster together. They did not readily burst. They appeared to crowd upwardly into the rag layer.

Yet the sacks did not remain in the rag layer indefinitely. They appeared to penetrate the rag layer and, after residing there briefly (a minute or two), they started moving downwardly through the rag layer and then sank through the middlings to the bottom of the vessel chamber. This meant that the sacks underwent a change in composite density and acquired a density greater than that of the middlings. At the same time, the layer of hydrocarbons above the rag increased in volume and excess hydrocarbon overflowed the vessel. Since there was no input of hydrocarbons to the top layer, other than from the sacks, and since no sacks entered the hydrocarbon phase, it follows that the sacks were leaking hydrocarbons through their permeable clay skins. Hence the expression "leaky sacks".

It is our belief that the rag layer becomes a zone of compression, whereby buoyancy force from the middlings compresses the sacks against the layer of hydrocarbons. As a result of this compression, hydrocarbons within a sack pass through the clay skin and enter the hydrocarbon phase above the rag. It is mostly the uppermost sacks in the rag layer that are partially emptied of hydrocarbon by compression. These sacks increase in composite density and sink to the base of the vessel chamber. However, even though they are denser than the middlings, the descending sacks still contain some hydrocarbons. They are only partially deflated. This is clearly visible in the glass vessel, since their shape is now different. During the initial floating period, a sack is spherical and full. When a sack sinks, it is thin and deflated.

The process of hydrocarbon release from the sacks occurs only at a limited rate. We refer to it as "rate of rag permeability". That is, there is only a certain volume of hydrocarbon that can be released through a unit area of the rag layer in a unit of time. If the delivery of new sacks to the bottom of the rag layer exceeds the rate of rag permeability, the hydrocarbon release from the sacks becomes the limiting factor and the process stalls gradually. The process of emptying the sacks does not respond well to an increase in the rate of delivery. More sacks enter the rag layer from the bottom than can be emptied by the gentle compression of the layer. The depth of the rag layer therefore grows. This increases the depth of rag that must be penetrated by new sacks and by hydrocarbon released from them. The increased rag depth also hinders the removal of partially emptied sacks from the rag layer. This leads to downward rag build-up with the result that rag is withdrawn by the underflow pump, causing an increase in hydrocarbons loss with the splitter tails.

As a result of considerable experimentation, we have determined a preferred limit of splitter feed rate in $m^3/h$ for each square meter of rag horizontal cross-sectional area in the splitter chamber. This flux limit is less than 6 $m^3/h$ of splitter feed for each $m^2$ of rag area. More preferably the flux should be less than about 4 m/h. At the high end of flux, the loss of hydrocarbons with the splitter tails begins to increase. For example, at a flux of 8 m/h the loss becomes excessive and may jeopardize the performance of the scrubber. This is because the diluent/bitumen ratio in the scrubber will be reduced.

The splitter operation does not appear to be a perfect process. Some small droplets of water (a few microns in diameter) also make their way into the hydrocarbon phase. The hydrocarbon layer is found to contain small quantities of water (3 to 5%) and clays (1.5 to 2.5%), present in the form of tiny droplets. Microscopic examination indicates that the clays are suspended in water and the surfaces of water droplets are coated with clay particles. The composite droplets resist coalescence and appear very stable. Removal or separation of these micron sized droplets by gravity settling is very slow. However, we have shown that, by prolonged settling, preferably coupled with the addition of known demulsifier chemical, the composite water/clay droplets can be flocculated or coalesced into much larger structures which will settle out of the hydrocarbon phase over a period of hours.

We have also shown that a scrubbing action with a high diluent/bitumen ratio (4:1 to 10:1) is effective to recover residual bitumen from the splitter tails, to reduce the loss of hydrocarbons with the scrubber tails to less than 1.0% bitumen and less than 6% naphtha. Most of the naphtha in scrubber tails can be further recovered by steam stripping in a naphtha recovery unit.

Broadly stated, the invention in one embodiment is a process for cleaning naphtha-diluted bitumen froth ("dilfroth") comprising bitumen and naphtha hydrocarbons contaminated with water and solids, the solids comprising sand and fine clay particles ("fines"), comprising: providing a splitter vessel forming a vapor-tight chamber for gravity settling, said vessel having an overflow outlet at its upper end, an underflow outlet at its lower end and means for feeding incoming dilfroth into the chamber; feeding dilfroth into the chamber through the feed means and temporarily retaining it therein so that the dilfroth separates to form a bottom layer of tails comprising aqueous middlings and sand, said tails containing some hydrocarbons, an intermediate layer of rag comprising water, fines and hydrocarbons collected in discrete three dimensional structures, and a top layer of raw dilbit comprising hydrocarbons containing some water and fines, said middlings combining with the rag and dilbit to create a discernible hydrocarbons/water interface; the feed means being operative to directly feed the incoming dilfroth into the middlings; removing dilbit through the overflow outlet; and removing tails through the underflow outlet, said tails containing less than 20 wt. % of the hydrocarbons in the froth.

Broadly stated, in another embodiment the invention is a process for cleaning naphtha-diluted bitumen froth ("dilfroth") comprising bitumen and naphtha hydrocarbons contaminated with water and solids, the solids comprising sand and fine clay particles ("fines"), comprising: subjecting the dilfroth to gravity settling in a vapor-tight splitter chamber to produce an overflow stream of raw dilbit, comprising hydrocarbons containing water and fines, the proportion of water and fines being small relative to the hydrocarbons, and an underflow stream of splitter tails, comprising aqueous middlings and sand; and subjecting the raw dilbit to gravity settling in a vapor-tight polisher chamber for sufficient time to produce an overflow stream of polished dilbit containing less than 1.0 wt. % water and 0.3 wt. % solids and an underflow stream of polisher sludge.

Broadly stated, in another embodiment the invention is a process for cleaning naphtha-diluted bitumen froth ("dilfroth") comprising bitumen and naphtha hydrocarbons and being contaminated with water and solids, the solids comprising sand and fine clay particles ("fines"), comprising: subjecting the dilfroth to gravity settling in a vapor-tight splitter chamber to produce an overflow stream of raw dilbit, comprising hydrocarbons containing water and fines, the proportion of water and fines being small relative to the hydrocarbons, and an underflow stream of splitter tails, comprising aqueous middlings and sand, said tails containing less than 20 wt. % hydrocarbons; mixing the splitter tails with additional naphtha and subjecting the produced mixture to gravity settling in a vapor-tight scrubber chamber to produce an overhead stream of scrubber hydrocarbons and an underflow stream of scrubber tails; and recycling scrubber hydrocarbons to the splitter chamber.

DESCRIPTION OF THE DRAWINGS

FIG. 3 is a plot showing dilbit water content when settled over time when the dilbit does not contain demulsifier; and FIG. 4 is a plot showing dilbit water content when settled over time when the dilbit contains demulsifier.

DESCRIPTION OF THE PREFERRED EMBODIMENT

Figure 1:
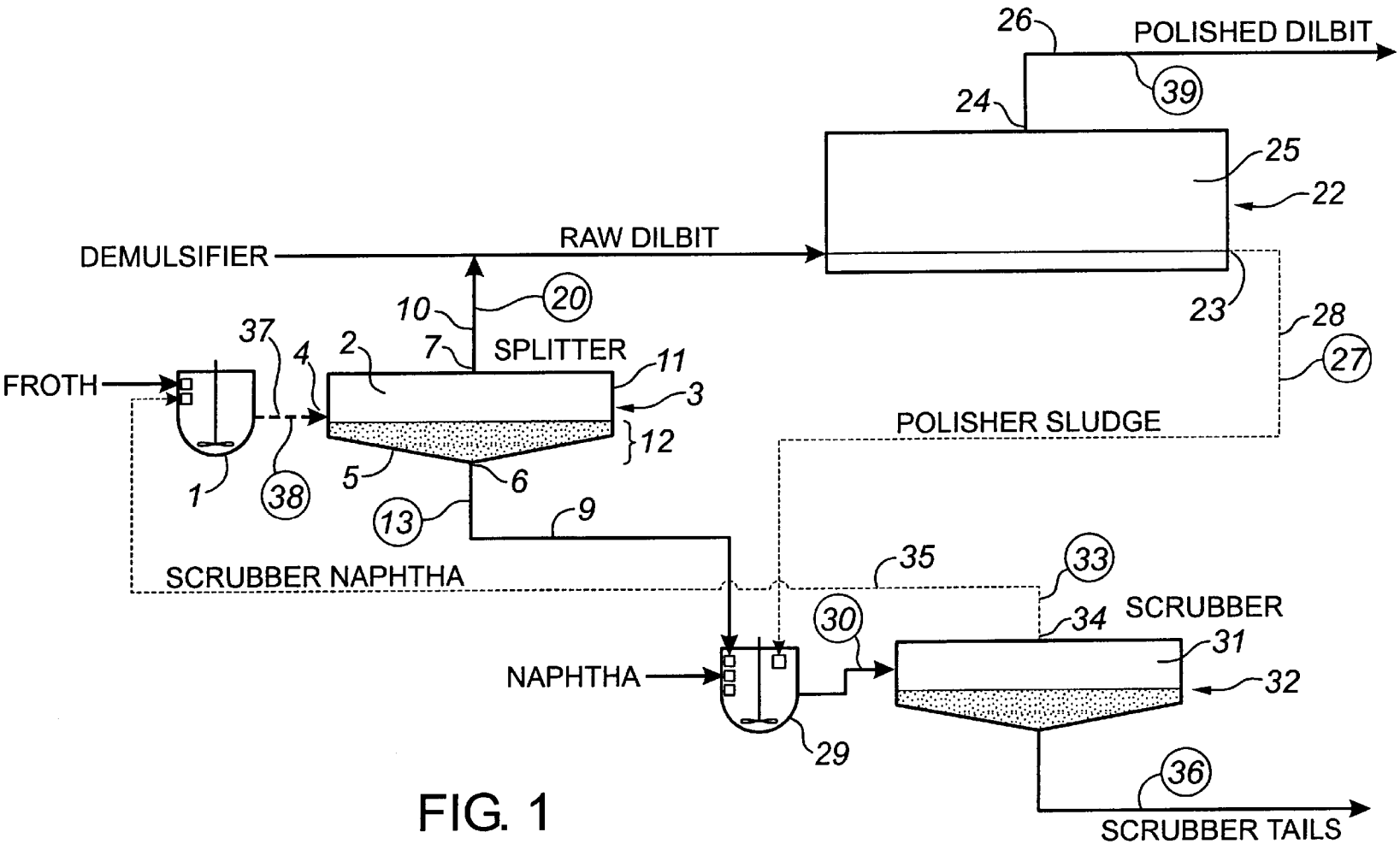
FIG. 1 is a schematic showing a preferred embodiment of the vessels and steps of the process

The invention is concerned with a process for cleaning diluent-diluted bitumen froth by reducing the content of contaminants, specifically water and solids.

Bitumen froth is initially received from a plant (not shown) for extracting bitumen from oil sand using the known hot water process. The froth, as received, is at elevated temperature (for example 85° C.) and typically comprises:

| | |
|---|---|
| bitumen- | 60% |
| water- | 30% |
| solids- | 10% |

A light hydrocarbon diluent, such as process naphtha, is mixed with the froth in a mixer 1 to provide diluent-diluted bitumen froth. The naphtha is preferably at least partly supplied by recycling scrubber naphtha, produced as described below.

The scrubber naphtha is supplied in an amount such that the naphtha/bitumen ratio of the diluent-diluted froth ("dilfroth") is preferably in the range 0.5–0.8, most preferably about 0.65.

The dilfroth 38 is fed by line 1 from the mixer 37 into the chamber 2 of a gravity settler vessel, referred to as the "splitter" 3. The dilfroth 38 is fed into the chamber 2 through inlet means 4. The splitter 3 has a conical bottom 5. It has underflow and overflow outlets 6, 7 at its bottom and top ends, respectively. A pump 8 and line 9 withdraw a stream of splitter tails 13 through the underflow outlet 6. Splitter overflow line 10 collects an overflow stream of raw dilbit.

The rate at which dilfroth 38 is fed to the splitter chamber 2 and the diameter of the cylindrical section 11 of the splitter 3 are selected to ensure a preferred flux of <6 m/h, most preferably about 4 m/h.

The dilfroth 38 is temporarily retained in the splitter chamber 2 for sufficient time so that gravity settling takes place to produce the following:

a bottom layer 12 of splitter tails 13, comprising mainly sand 14 and aqueous middlings 15, said tails containing some hydrocarbons;

an intermediate layer 16 of rag 17, said rag comprising mainly hydrocarbons associated with water and fines in discrete three dimensional structures or sacks 18; and a top layer 19 of raw dilbit 20 comprising mainly hydrocarbons containing some water and fines (clay particles).

The middlings 15 combine with the rag 17 and raw dilbit 20 to create a discernible hydrocarbons/water interface 21.

The splitter inlet means 6 delivers incoming dilfroth 38 into the middlings 15 across the cross-section of the splitter chamber 2, at an elevation spaced below the layer of rag 17 and well above the underflow outlet 6.

Means, such as a capacitance probe, may be used to monitor the elevation of the hydrocarbons/water interface 21. The rates of feeding dilfroth 38 and withdrawing tails 13 may then be controlled in response to the probe readings to maintain the elevation of the interface 21 generally constant. It is of course desirable to keep the interface 21 away from the bottom of the splitter chamber 2, to minimize hydrocarbon losses with the splitter tails 13. Alternatively one may monitor the composition of the splitter tails 13 and vary the rates with the objective of keeping the tails hydrocarbon content below a predetermined value, usually less than 15%.

The raw dilbit 20 produced through the splitter overflow outlet 7 is pumped through line 10 to a flat-bottomed, vapor-tight tank, referred to as the "polisher" 22, and subjected to gravity settling therein. Preferably a demulsifier is added to the raw dilbit 20 as it moves through the line 10. For example, 40 ppm of Champion MR 1216™ demulsifier may be added for this purpose.

The polisher 22 has a bottom underflow outlet 23 and a top overflow outlet 24.

The raw dilbit/demulsifier mixture is temporarily retained for a prolonged period (for example, 24 hours) in the polisher chamber 25. Water droplets coalesce and settle, together with fines. Polished dilbit 39 is removed as an overflow stream from the polisher 22 through line 26. The polished dilbit 39 is found to comprise hydrocarbons, typically containing <1.0 wt. % water and <0.3 wt. % solids. Polisher sludge 27, comprising water, solids and less than 15% hydrocarbons, is removed from the polisher 22 as an underflow stream through line 28. It is pumped through line 28 into scrubber mixer 29.

The splitter tails 13 produced through the splitter underflow outlet 6 are also pumped through line 9 to scrubber mixer 29. Naphtha is added to the splitter tails 13 and polisher sludge 27 in the scrubber mixer 29 to produce a scrubber feed 30 preferably having a naphtha/bitumen ratio in the range 4 to 10, more preferably 5 to 8. The scrubber feed 30 is introduced into the chamber 31 of a vapor-tight vessel, referred to as the "scrubber" 32. The scrubber feed 30 is temporarily retained in the scrubber chamber 31 (for example for 20 to 30 minutes) and subjected to gravity settling therein A scrubber overflow stream 33 of hydrocarbons, mainly comprising naphtha associated with some bitumen, is removed through an overflow outlet 34 and recycled through line 35 to splitter mixer 37. A scrubber underflow stream of scrubber tails 36, comprising water and solids containing some hydrocarbons, is removed and forwarded to a naphtha recovery unit (not shown).

The nature and utility of the process is demonstrated by the following examples.

EXAMPLE 1

Splitter and Polisher

This example demonstrates the results obtained when a splitter and polisher were operated together in series.

Figure 2A:
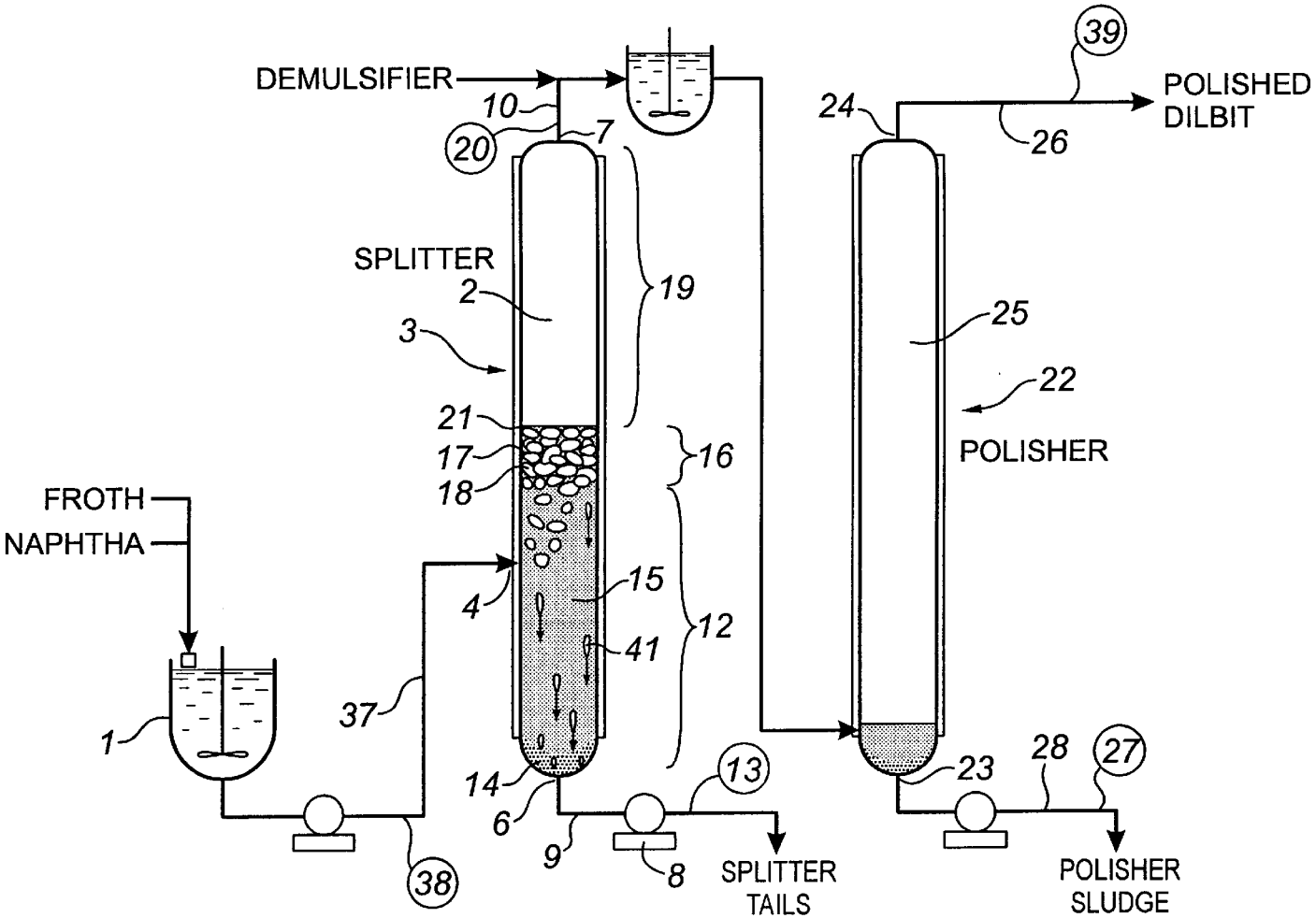
FIG. 2*a* is a schematic showing the laboratory pilot circuit, in polishing configuration, as used to develop the data of Example I.

In this experiment, two glass columns were supplied as splitter and polisher and connected as shown in FIG. 2*a*. Hot bituminous froth and naphtha were combined in an agitated mixer 37, at naphtha/bitumen ratios of 0.55/1.0 by weight. The mixture was pumped continuously, at a rate of 191 g/min, to the splitter column 3 (ID—125 mm and height—750 mm). The calculated splitter flux was 0.93 m/h.

The separation process was clearly visible through the glass walls of the splitter column, with coarse sand settling and hydrocarbon sacks 40 floating. The full sacks 40 accumulated at the aqueous/hydrocarbon interface 21 and a deep layer 19 of hydrocarbon formed above the interface. After residing at the interface for a few minutes, partially emptied sacks 41 of hydrocarbon were observed sinking and joining the settled solids or splitter tails 13 at the bottom. The rate of the splitter tails stream withdrawal through line 9 was adjusted manually to maintain the level of aqueous/hydrocarbon interface 21 a few inches above the feed injection point 42.

As shown in Table 1, the splitter overflow or raw dilbit 20 contained about 4.57% water and 0.76% solids.

The splitter overflow was continuously fed through line 10 into the polisher 22, where the residence time was about 35 min. During this short residence time, water content in the polisher overflow (polished dilbit) dropped to 2.91% and solids content down to 0.36%. This polished dilbit quality would not be adequate for further processing in the bitumen upgrading plant.

TABLE 1

Summary of continuous splitter/polisher operation without demulsifier

| | Splitter Feed | Splitter Overflow | Splitter Underflow | Polisher Overflow | Polisher Underflow |
|---|---|---|---|---|---|
| Flow Rate, mg/l | 191.14 | 145.96 | 45.18 | 132.29 | 13.67 |
| Bitumen, % | 48.16 | 59.72 | 10.81 | 60.02 | 56.71 |
| Naphtha, % | 26.57 | 32.65 | 6.92 | 34.36 | 16.04 |
| Water, % | 19.97 | 4.57 | 69.68 | 2.91 | 20.72 |
| Solids | 4.77 | 0.76 | 17.75 | 0.36 | 4.58 |

To improve dilbit quality, a series of experiments were conducted to investigate the effects of demulsifier addition and prolonged settling. In one such experiment, demulsifier was continuously injected into the splitter overflow, at a dosage of 40 ppm, before it entered the polisher column. When the polisher column was completely filled with the demulsifier-treated raw dilbit, the operation was stopped. At this point, both the splitter and polisher columns were completely filled with dilbit. However, the first splitter column contained dilbit with no demulsifier and the polisher column contained dilbit with 40 ppm of demulsifier. The diluted bitumen in the two columns was allowed to stand for up to 26 h while the temperature inside the columns was controlled at 80° C., by re-circulating hot water through water jackets. Samples from different depths of the two vessels were taken periodically for water content analysis by Karl Fisher titration.

FIG. 3 shows the water contents in diluted bitumen remaining in the first column, as a function of settling time. As illustrated, the water content dropped from 3.5% to 2.8% in the first hour and to 2.4% within 3 hours. After settling for 6 hours, the water content stayed at a constant level, 2.2%. Further increases in settling time, up to 25 h, did not change the water content at all. This indicates that the final concentration of 2.2% was very stable. Without demulsifier, it was not possible to remove the remainder of water by gravitational settling within a reasonable settling time.

However, in the second column, where 40 ppm of demulsifier were present in the dilbit, the removal of water improved dramatically, as shown in FIG. 4. Water content dropped from 3.5% to 1.3%, even during the continuing operation, when the second column was filling up (about 30 min). After 3 hours of settling, water content dropped to 0.8% and eventually down to 0.2% over the 26 hour period. As demonstrated, the addition of demulsifier to the polisher feed, combined with extended settling, can produce essentially dry dilbit.

FIGS. 3 and 4 also show that the water contents at different depths are almost the same, in the range of depths studied in this work. This reveals that the water separation is not a simple droplet settling process, where settling velocity is controlled by the size of droplets as introduced in the feed. Based on the test results, we postulate that the demulsifier de-stabilizes the water emulsion and allows small droplets to form much larger aggregates. Once the droplets agglomerate to larger formations, they settle out very quickly through the entire depth of the oil phase. The residence time, required in the polisher, is the time needed for the process of droplet agglomeration to be completed.

In summary, the splitter overflow raw dilbit advantageously can be treated by the addition of suitable demulsifier and settling in a separate vessel for sufficient time to achieve the desired level of water content. With addition of appropriate demulsifier and given sufficient settling time (at least 12 h), a very high quality dilbit can be produced.

EXAMPLE 2

Splitter and Scrubber

Figure 2B:
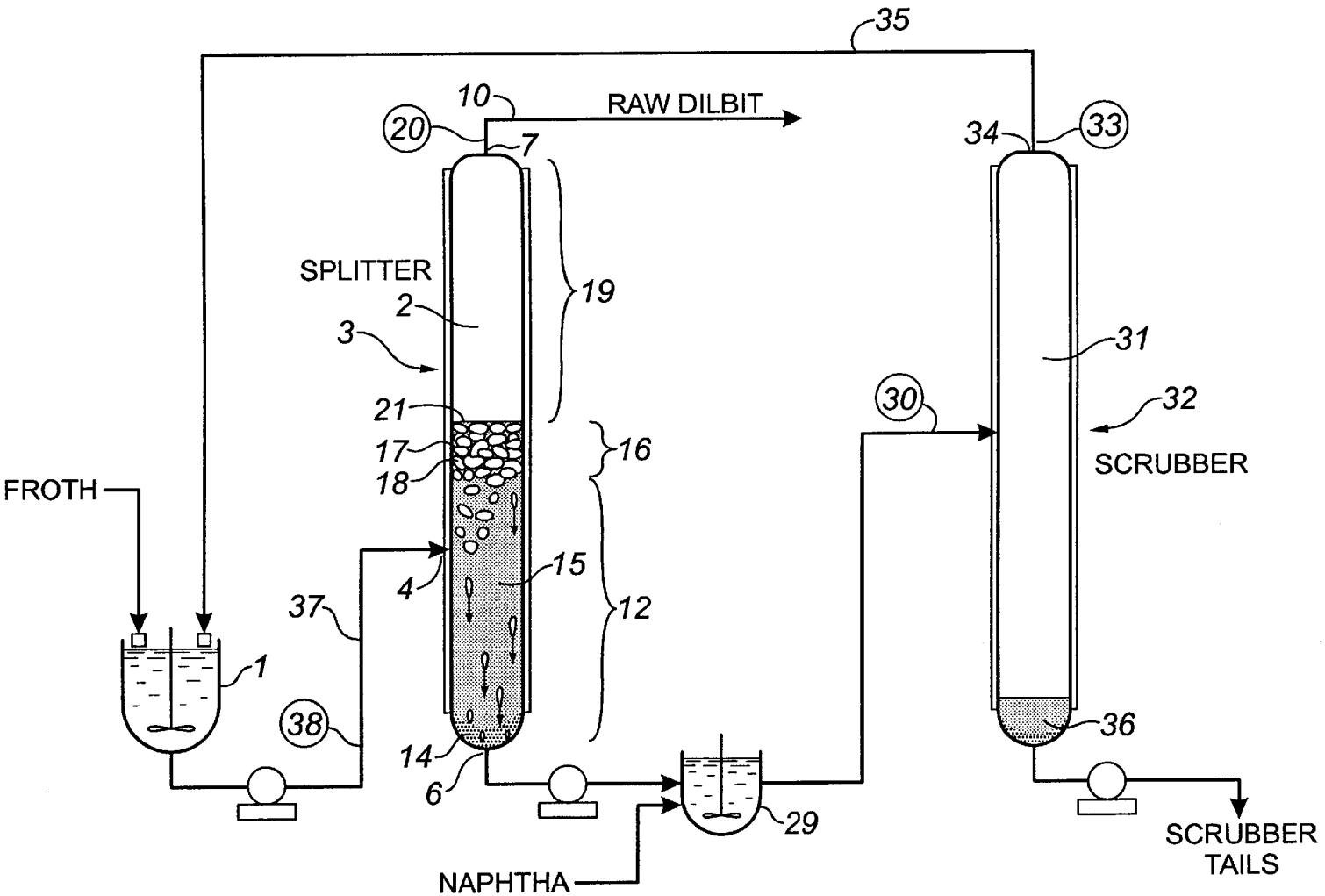
FIG. 2*b* is a schematic showing the laboratory pilot circuit, in scrubbing configuration, as used to develop the data of Example II.

In another experiment, the same two columns were connected as shown in FIG. 2*b* and operated as splitter and scrubber. Bituminous froth was initially mixed with fresh naphtha in the feed mixer 37 and introduced to the splitter column as described in Example 1. The separation process in the splitter column was the same as in experiment 1. The splitter overflow stream was weighed and sampled. The tailings stream from the splitter was mixed with fresh naphtha, added at a rate of 64.35 g/minute, and introduced to the scrubber column. Since the amount of bitumen remaining in splitter tails was only a small fraction of the total hydrocarbon ("HC") entering the process, the N/B ratio in the scrubber was an order of magnitude higher than that in the splitter feed. As previously explained, it was determined that at N/B ratios exceeding 4/1, the HC/clay structures responsible for the formation of the rag become unstable.

The released HC in the scrubber overflow contained very little water and solids, whereas the scrubber underflow tails contained very little hydrocarbon. As soon as the scrubber overflow stream became available for re-circulation, we discontinued the addition of fresh naphtha to the fresh froth and replaced it with the high N/B scrubber overflow. The process continued for four hours, until we were satisfied that a steady flow condition was reached. The material balance data, recorded during the steady state condition, are shown in Table 2.

TABLE 2

Summary of continuous splitter/scrubber operation without demulsifier

| | Splitter Feed | Splitter Overflow | Splitter Underflow | Scrubber Feed | Scrubber Overflow | Scrubber Underflow |
|---|---|---|---|---|---|---|
| Flow Rate, mg/l | 259.59 | 183.55 | 76.03 | 140.38 | 80.60 | 59.78 |
| Bitumen, % | 46.57 | 57.77 | 19.51 | 10.56 | 17.10 | 1.75 |
| Naphtha, % | 30.05 | 37.69 | 11.59 | 51.97 | 89.95 | 0.78 |
| Water, % | 18.08 | 3.57 | 53.09 | 28.76 | 1.09 | 66.06 |
| Solids, % | 3.48 | 0.68 | 10.23 | 5.54 | 0.06 | 27.48 |

Bitumen and naphtha recoveries in this experiment were 99.43% and 99.14% respectively.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

From the foregoing description, one skilled in the art can easily ascertain the essential characteristics of this invention, and without departing from the spirit and scope thereof, can make various changes and modifications of the invention to adapt it to various usages and conditions.

The embodiments of the invention in which an exclusive property or privilege is claimed are defined as follows:

1. A process for cleaning naphtha-diluted bitumen froth ("dilfroth") comprising bitumen and naphtha hydrocarbons contaminated with water and solids, the solids comprising sand and fine clay particles ("fines"), comprising:

providing a splitter vessel forming a vapor-tight chamber for gravity settling, said vessel having an overflow outlet at its upper end, an underflow outlet at its lower end and means for feeding incoming dilfroth into the chamber;

feeding dilfroth into the chamber through the feed means and temporarily retaining it therein so that the dilfroth separates to form a bottom layer of tails comprising aqueous middlings and sand, said tails containing some hydrocarbons, an intermediate layer of rag comprising water, fines and hydrocarbons collected in discrete three dimensional structures, said rag layer having a horizontal cross-sectional area, and a top layer of raw dilbit comprising hydrocarbons containing some water and fines, said middlings combining with the rag and dilbit to create a discernible hydrocarbons/water interface;

the feed means being operative to directly feed the incoming dilfroth into the middlings;

removing dilbit through the overflow outlet; and removing tails through the underflow outlet, said tails containing less than 20 wt. % of the hydrocarbons in the froth.

2. The process as set forth in claim 1 wherein:

the naphtha/bitumen ratio in the dilfroth is in the range 0.4:1 to 0.8:1; and incoming dilfroth is fed into the chamber at less than 6 $m^3/h$ for each $m^2$ of horizontal cross-sectional rag area.

3. The process as set forth in claim 1 wherein incoming dilfroth is fed into the chamber at less than 4 $m^3/h$ for each $m^2$ of horizontal cross-sectional rag area.

4. The process as set forth in claim 2 wherein the dilbit contains less than 3% solids and less than 8% water.

5. A process for cleaning naphtha-diluted bitumen froth ("dilfroth") comprising bitumen and diluent hydrocarbons contaminated with water and solids, the solids comprising sand and fine clay particles ("fines"), comprising:

subjecting the dilfroth to gravity settling in a vapor-tight splitter chamber to produce an overflow stream of raw dilbit, comprising hydrocarbons containing water and fines, the proportion of water and fines being small relative to the hydrocarbons, and an underflow stream of splitter tails, comprising aqueous middlings and sand; and subjecting the raw dilbit to gravity settling in a vapor-tight polisher chamber for sufficient time to produce an overflow stream of polished dilbit containing less than 1.0 wt. % water and less than 0.3 wt. % solids and an underflow stream of polisher sludge.

6. The process as set forth in claim 5 comprising:

adding demulsifier to the raw dilbit treated in the second chamber.

7. A process for cleaning naphtha-diluted bitumen froth ("dilfroth") comprising bitumen and naphtha hydrocarbons and being contaminated with water and solids, the solids comprising sand and fine clay particles ("fines"), comprising:

subjecting the dilfroth to gravity settling in a vapor-tight splitter chamber to produce an overflow stream of raw dilbit, comprising hydrocarbons containing water and fines, the proportion of water and fines being small relative to the hydrocarbons, and an underflow stream of splitter tails, comprising aqueous middlings and sand;

mixing the splitter tails with additional naphtha and subjecting the produced mixture to gravity settling in a vapor-tight scrubber chamber to produce an overhead stream of scrubber hydrocarbons and an underflow stream of scrubber tails; and recycling scrubber hydrocarbons to the splitter chamber.

8. The process as set forth in claim 7 wherein sufficient naphtha is mixed with the tails to provide a naphtha/bitumen ratio in the range 4:1 to 10:1.

9. A process for cleaning naphtha-diluted bitumen froth ("dilfroth") comprising bitumen and naphtha hydrocarbons contaminated with water and solids, the solids comprising sand and fine clay particles ("fines"), comprising:

subjecting the dilfroth to gravity settling in a vapor-tight splitter chamber to produce an overflow stream of raw dilbit, comprising hydrocarbons containing water and fines, and an underflow stream of splitter tails, comprising aqueous middlings and sand;

mixing the splitter tails with additional naphtha and subjecting the produced mixture to gravity settling in a vapor-tight scrubber chamber to produce an overhead stream of scrubber hydrocarbons and an underflow stream of scrubber tails; and subjecting the raw dilbit to gravity settling in a vapor-tight polisher chamber for sufficient time to produce an overflow stream of polished dilbit and an underflow stream of polisher sludge.

10. The process as set forth in claim 9 comprising:

recycling scrubber hydrocarbons to the first zone.

11. The process as set forth in claim 10 comprising:

adding demulsifier to the raw dilbit treated in the polisher chamber.

12. The process as set forth in claim 11 wherein:

the diluent/bitumen ratio in the dilfroth is in the range 0.4:1 to 0.8:1.

13. The process as set forth in claim 12 wherein sufficient naphtha is mixed with the splitter tails to maintain the naphtha/bitumen ratio in the scrubber chamber in the range 4:1 to 10:1.

14. The process as set forth in claim 13 wherein the polished dilbit contains less than 1.0 wt. % water and less than 0.3 wt. % solids.

15. The process as set forth in claim 14 wherein incoming dilfroth is fed into the splitter chamber at less than 6 $m^3/h$ for each $m^2$ of said chamber's horizontal cross-sectional area.

* * * * *